United States Patent [19]

Feichtiger et al.

[11] 4,253,319

[45] Mar. 3, 1981

[54] PNEUMATIC CENTRAL LOCKING MECHANISM FOR DOORS AND HINGED COVERS IN MOTOR VEHICLES

[75] Inventors: Dieter Feichtiger, Aidlingen; Rüdiger Hoffmann, Sindelfingen, both of Fed. Rep. of Germany

[73] Assignee: Daimler-Benz Aktiengesellschaft, Fed. Rep. of Germany

[21] Appl. No.: 49,033

[22] Filed: Jun. 15, 1979

[30] Foreign Application Priority Data

Jun. 16, 1978 [DE] Fed. Rep. of Germany ..... 2826354

[51] Int. Cl.[3] ..... E05B 65/38

[52] U.S. Cl. ..... 70/264; 180/289; 200/83 Q

[58] Field of Search ..... 70/264; 180/289; 200/83 Q, 83 R

[56] References Cited

U.S. PATENT DOCUMENTS

| | | | |
|---|---|---|---|
| Re. 28,142 | 9/1974 | Kazaoka | 180/289 |
| 2,253,365 | 8/1941 | Dawson | 200/83 Q X |
| 2,470,581 | 5/1949 | Seaman | 70/264 |
| 2,799,154 | 7/1957 | Beal | 70/264 |
| 3,045,775 | 7/1962 | Pretini | 180/289 X |
| 3,105,127 | 9/1963 | Peters | 200/83 R |
| 3,633,391 | 1/1972 | Andres et al. | 70/264 |
| 4,181,191 | 1/1980 | Hoffmann et al. | 70/264 X |

FOREIGN PATENT DOCUMENTS

| | | | |
|---|---|---|---|
| 2556289 | 6/1977 | Fed. Rep. of Germany | 200/83 R |
| 1492610 | 7/1967 | France | 70/264 |
| 1554758 | 12/1968 | France | 70/264 |
| 983820 | 2/1965 | United Kingdom | 70/264 |

*Primary Examiner*—Roy D. Frazier
*Assistant Examiner*—Carl F. Pietruszka
*Attorney, Agent, or Firm*—Craig & Antonelli

[57] ABSTRACT

A pneumatic central locking mechanism for doors and/or hinged covers of automotive vehicles wherein one pneumatic operating member is provided at the doors or hinged covers to be locked by the central locking operation for locking and unlocking locking devices associated with such doors and covers. A pump, drivable by an electric motor, produces excess pressure and vacuum with a reversing valve being provided for selectively delivering the excess pressure and vacuum to the pneumatic operating members. The reversing valve is operated by a pneumatic operating member which is pneumatically connected in parallel, by way of a throttle, to the operating members associated with the doors and hinged covers. Two double throw switch arrangements are provided with one of the double throw switch arrangements being actuated by the further operating member.

21 Claims, 3 Drawing Figures

PNEUMATIC CENTRAL LOCKING MECHANISM FOR DOORS AND HINGED COVERS IN MOTOR VEHICLES

The present invention relates to a locking mechanism and, more particularly, to a pneumatic central locking mechanism for doors and hinged covers of motor vehicles.

In Offenlegungschrift No. 27 15 136.6, corresponding to commonly assigned copending U.S. application Ser. No. 893,529 now U.S. Pat. No. 4,181,191, a pneumatic central locking mechanism for doors and hinged covers of automotive vehicles is proposed with respectively one pneumatic operating member fashioned as a single chamber element being associated with each of the doors and/or hinged covers participating in a central locking operation. Respective single feed lines lead to each of the operating members which lines, by way of a reversing valve, can be selectively under the effect of excess pressure or a vacuum by means of an air pump which is drivable by an electric motor. On the one hand, the air pump produces excess pressure and, on the other hand, a vacuum with the pump previously producing, as required, the respective pressure necessary for an operating process of the central locking mechanism. The electric motor is turned on by way of a switch concomitantly activated during a key-operated actuation of the second locking device and turned off again with a delay.

In proposed central locking mechanisms, the electric motor producing the pneumatic energy for a locking operation is shut off in dependence upon time. Since the locking operations have varying durations depending on the outside temperature and on the upkeep of the locking mechanism, a shutoff of the electric motor after a termination of the locking operation in dependence on a time interval is unfavorable. For example, if during the cold season, if too short a time delay is set, it may happen that the locking mechanism is turned off even before a locking operation has been completed. However, if the time delay is very long, then the electric motor after performing the locking operations may run for an unnecessarily long additional period during the warm season causing a troublesome noise and, as can be appreciated, both of these aspects would be undesirable.

The aim underlying the present invention essentially resides in providing a pneumatic central locking mechanism for doors and/or hinged covers or lids of motor vehicles wherein a delayed shutoff for the electric motor which, independently of the speed at which the locking ooeration proceeds, will cut out the electric motor in all cases only after a completion of a locking operation.

In accordance with advantageous features of the present invention, the reversing valve by which the lines can be selectively placed under excess pressure or vacuum, is operated by a further pneumatic operating member also fashioned as a single chamber element with this latter operating member being pneumatically connected in parallel by way of a throttle to the operating members of the doors and/or hinged covers or lids and each time having to overcome a definite load resistance. The further operating member establishes at the reversing valve, after a completion of the locking operation to be effected, a switching position for the reversing valve required for the opposite locking operation. Furthermore, in addition to the switch operated by the key, constructed as a double throw switch or the like, namely, the first double throw switch, there is provided a second double throw switch which in each case is operated simultaneously with the first double throw switch by the further operating member. The first and second double throw switch are electrically connected together into the current supply for the electric motor in a switching position which is the opposite in the rest position of the central locking mechanism and effecting the shutoff of the electric motor.

By virtue of the pneumatically effected shutoff and due to the provision of the throttle, which establishes a ranking order among the pneumatic operating members, it is ensured that first the operating members for the locking devices of the doors and/or hinged covers or lids respond and only once these operating members have performed is it possible, by way of the throttle, for a sufficient pressure to build up also in the other operating member for the shut off. Thus, by virtue of the present invention, shutoff is effected not in dependence upon the time but rather in dependence upon the function.

Additionally, simultaneously with the shutoff step, the reversing valve is placed into a switching position for a subsequent reversed locking operation. It is necessary for a functionally dependent shutoff or switchover that the load resistance of the further operating member be higher than the load resistance to be overcome by the pneumatic operating members at the doors and/or hinged covers or lids.

In accordance with additional advantageous features of the present invention, a detent spring or a detent latch, which reverses its effective force direction when passing through a central position, is provided at the reversing valve and tensions a movable part of the reversing valve into one of two end positions. By virtue of the provision of the detent spring or detent latch of the reversing valve a definite load resistance is provided for the further operating member which load resistance is higher than the load resistance of any of the locking devices in the doors and/or hinged covers or lids to be centrally locked.

In accordance with the present invention, a lock cylinder is pivotable by actuation with a key with the lock cylinder being elastically tensioned from both directions of actuation into a middle rest position at the central locking station or stations of the motor vehicle. A movable part of the first double throw switch is coupled, by way of a defined clearance such as, for example, a slotted hole, corresponding approximately to the switching displacement of the double throw switch, to the lock cylinder and is provided with a catch or detent spring reversing its direction of force when passing through a central position with this detent spring tensioning the movable part of the first double throw switch into one of the two end positions.

If more than one central locking station is provided at the vehicle, in accordance with the present invention, each of the respective locking stations are provided with one pneumatic operating member arranged thereat. Moreover, the pneumatic operating members of the several central locking stations are each respectively coupled by way of a defined clearance corresponding to a switching distance of the lock means, especially, for example, a slotted hole, to the lock means of the corresponding door and/or hinged lid or cover.

In accordance with the present invention, a throttle is arranged in the feed lines to the pneumatic operating members of the hinged covers or lids of the vehicle with the pressure supply to the pneumatic operating members of the doors taking place without any obstruction or impediment.

Preferably, the effect of the throttle in the feed line to the hinged cover or lid operating members is lower than the effect of the throttle in the feed line to the further operating member.

Accordingly, it is an object of the present invention to provide a pneumatic central locking mechanism for doors and/or hinged covers or lids of motor vehicles which avoids, by simple means, shortcomings and disadvantages encountered in the prior art.

Another object of the present invention resides in providing a pneumatic central locking mechanism for doors and/or hinged covers or lids of motor vehicles whereby a shutoff of a drive motor for the pneumatic pump is effected in dependence upon a function of the locking process.

A further object of the present invention resides in providing a pneumatic central locking mechanism for doors and/or hinged covers or lids of motor vehicles which ensures that a cut-out of the locking mechanism will in all cases occur only after a completion of a locking operation.

A still further object of the present invention resides in providing a pneumatic central locking mechanism for doors and/or hinged covers or lids of automotive vehicles which is simple in construction and therefore relatively inexpensive to manufacture.

In another object of the present invention resides in providing a pneumatic central locking mechanism for doors and/or hinged covers or lids of motor vehicles which functions reliably under all operating conditions.

These and other objects, features, and advantages of the present invention will become more apparent from the following description when taken in connection with the accompanying drawings which show, for the purposes of illustration only, two embodiments in accordance with the present invention, and wherein.

Figure 2:
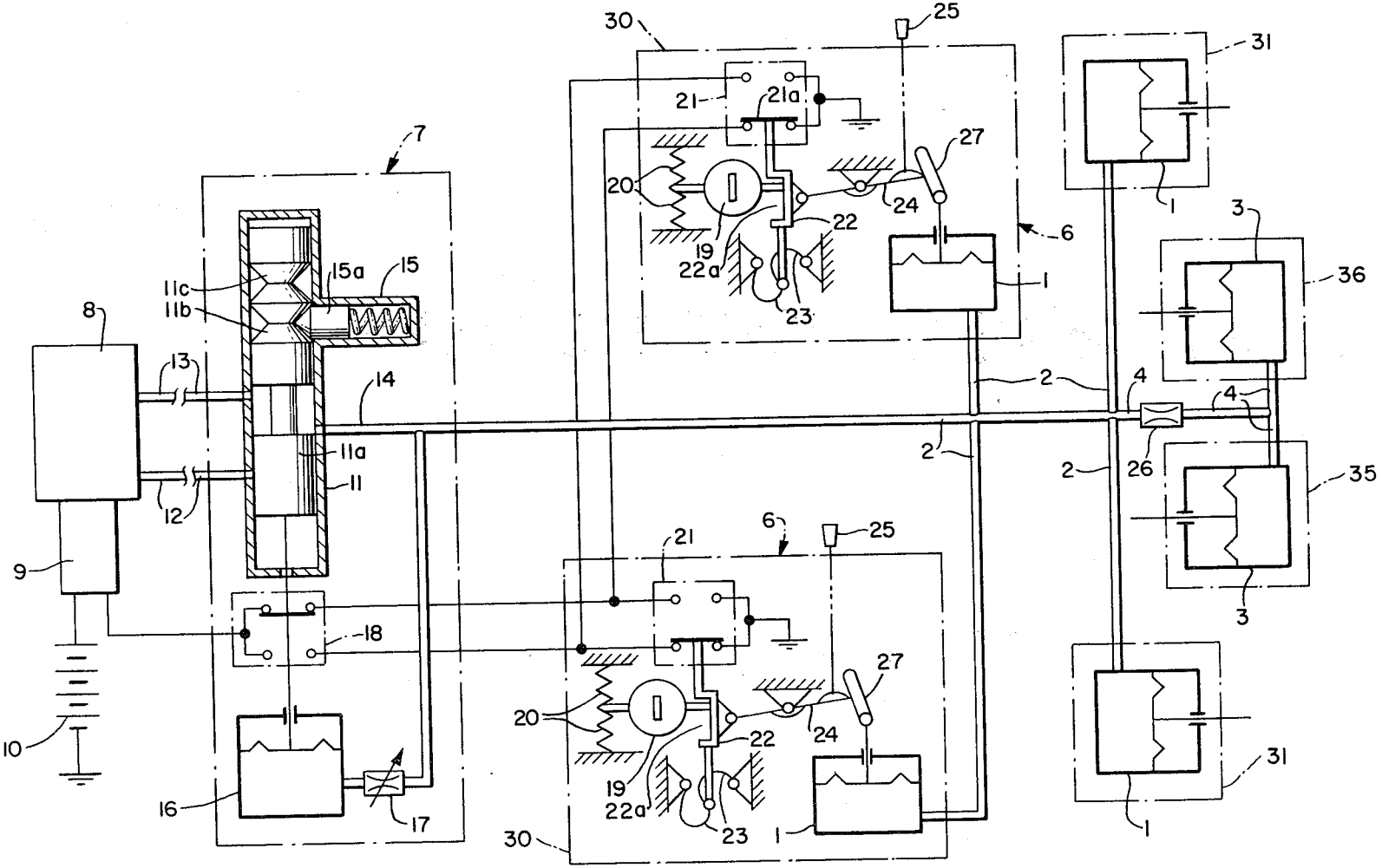
FIG. 2 is a schematic view of a pneumatic central locking mechanism in accordance with the present invention provided with two central locking stations.
Figure 3:
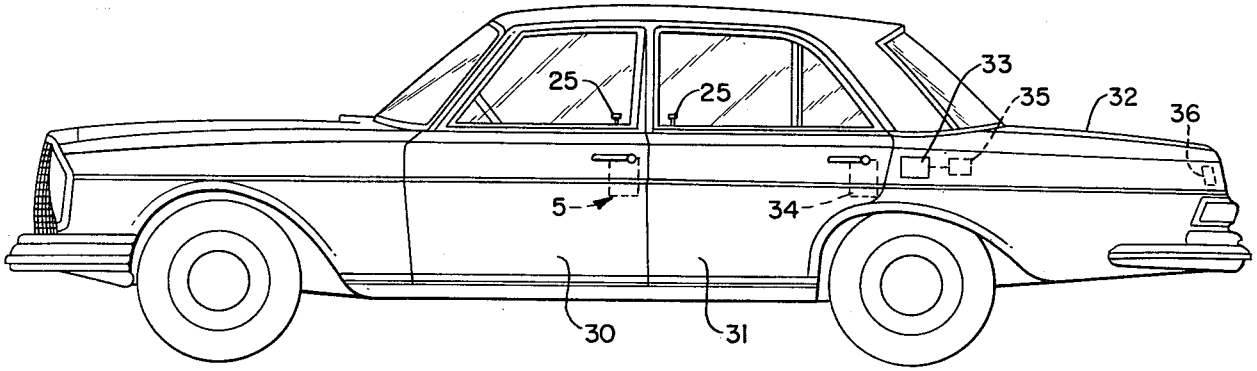
FIG. 3 is a side view of a motor vehicle illustrating the arrangement of the doors and hinged covers or lids controlled by the pneumatic central locking mechanism of the present invention.

Referring now to the drawings wherein like reference numerals are used throughout the various views to designate like parts and, more particularly, to FIG. 3, according to this Figure, a passenger motor vehicle generally designated by the reference numeral 29 is provided with front doors 30, rear doors 31, a trunk lid 32, and a hinged fuel tank cover 33. The door 30 disposed on the driver's side of the motor vehicle includes a central locking station 5 with locks 34 of the remaining doors, that is, the front door on the passenger side of the vehicle as well as the two rear doors 31, as well as the locks 35 and 36 of the trunk lid 32 and fuel tank cover 33 are adapted to be centrally operated or operated individually by way of manual locking buttons 25. Each lock 34, 35, 36 and/or each locking station 5, 6 (FIG. 2) to be locked centrally is associated with a pneumatic operating member each of which is constructed as a single chamber element and is adapted to be operated by pressure in one operating direction and by a vacuum in the other operating direction as will become more apparent from the following description relating to FIGS. 1 and 2.

Figure 1:
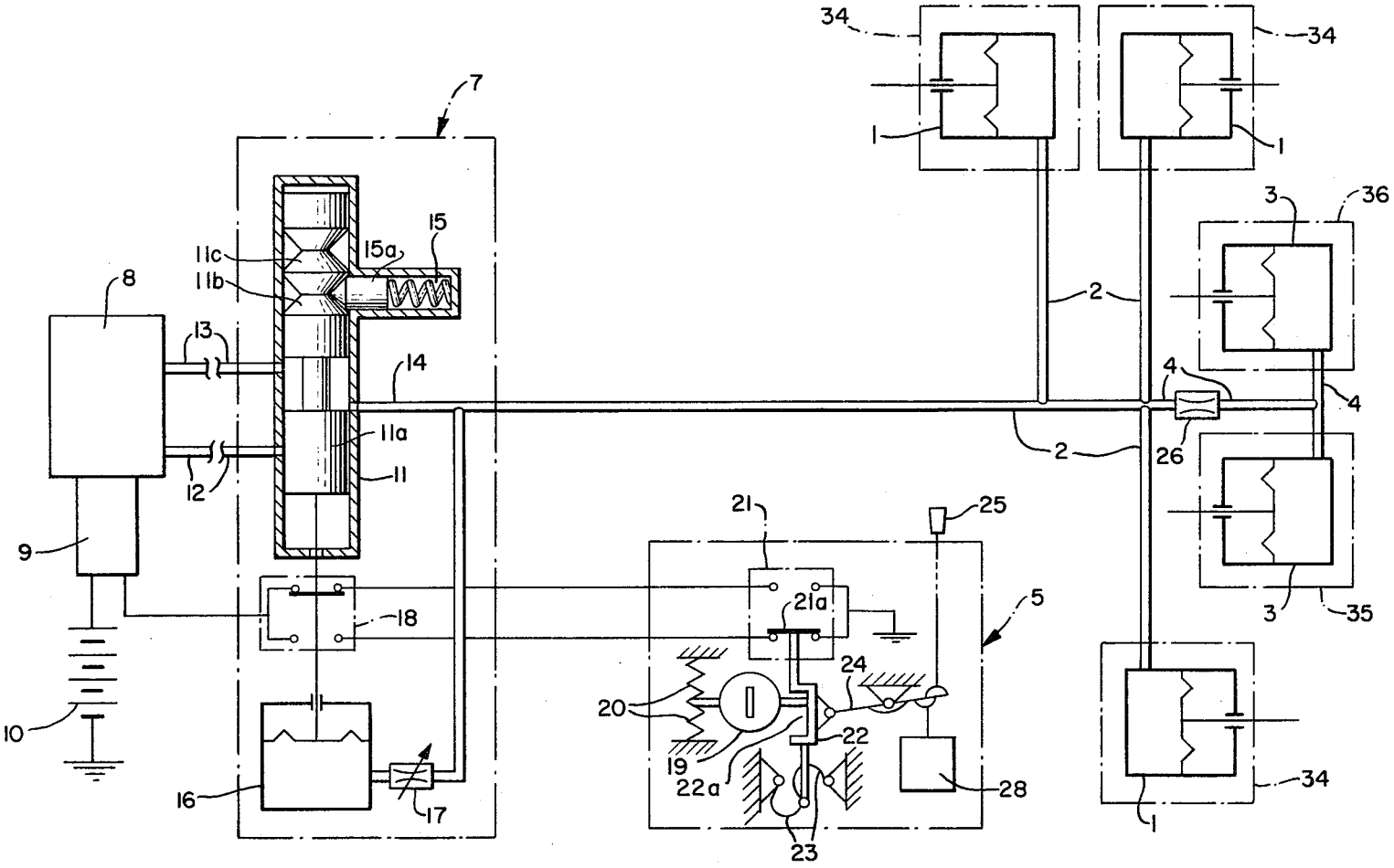
FIG. 1 is a schematic view of a pneumatic central locking mechanism for doors and hinged covers or lids of a motor vehicle with only one central locking station.

As shown most clearly in FIG. 1, only one central locking station 5 is provided and arranged at the front door on the driver's side of the vehicle. By activation of the central locking station 5 by a key (not shown) inserted into a lock cylinder 19, a pulse generator generally designated by the reference numeral 7 is actuated thereby temporarily setting an electric motor 9 into operation. The electric motor 9 is powered by a battery 10 of the vehicle 29 with the motor being adapted to drive an air pump 8 which is capable of producing an excess pressure as well as a vacuum. Suitable lines 12, 13 are provided for communicating the air pumps 8 with a reversing valve 11 of the pulse generator 7 with the line 12 providing the excess pressure and the line 13 providing the vacuum. In addition to the reversing valve 11, the pulse generator proper also includes a double throw switch 18 as well as a pneumatic operating member 16 for operating the double throw switch 18 and the reversing valve 11. The further operating member 16 is constructed as a single chamber element and is connected to a feed line or connection 14 of the reversing valve 11 and, consequently, is pneumatically connected in parallel to operating members 1 and 3 respectively associated with the doors 30, 31, trunk lid 32 and fuel tank cover 33. An adjustable throttle 17 is arranged in the supply line to the further operating member 16 whereby a delayed response is provided for the further operating member 16.

As shown in FIG. 1, the operating members 1 associated with the doors 30, 31 and the operating members 3 associated with the trunk lid 32 and fuel tank cover 33 are formed as single chamber elements and the operating members 1, 3 are fed also by respectively only by one line 2, 4.

A detent spring 15 is provided for urging a wedge-shaped index member **15*a* into grooves 11*b*, 11*c* provided in a movable part 11*a* of the reversing valve 11 with the grooves 11*b*, 11*c* defining end positions and, above all, a defined displacement force. The detent spring 15 and wedge-shaped indexing member 15*a* function so as to form a catch effective to secure the movable part 11*a*** in the defined positions. As can be appreciated, other valve constructions and, above all, also other catch-type securing means are likewise possible.

By appropriate inclination of the wedge-shaped grooves **11*a*, 11*b*, as well as by appropriate selection of the hardness or spring characteristic of the detent spring 5, a definite displacement force may be provided for the reversing valve 11. The displacement force is above the operating force for any of the locking devices in the doors 30, 31, fuel tank cover 33, and trunk lid 32 so as to ensure that the reversing valve 11 responds only at a higher vacuum or at a higher excess pressure than any one of the operating members 1 or 3 for the respective doors 30,31, trunk lid 32 and fuel tank cover 33**.

The lock cylinder, pivotable by a key, is arranged in the central locking station 5 of the door 30 disposed on the driver's side of the vehicle 29. The lock cylinder 19 is tensioned by springs 20 into a central rest position and the lock cylinder 19 also engages into a recess **22*a* of a longitudinally displaceable bar 22. The length of the recess 22*a* corresponds to a switching path during the locking or unlocking of the lock mechanism. The end positions of the bar 22** are fixed by a pair of catch springs 23. By means of this arrangement, an unequivocal and uniform switching position of the output member or bar 22 driven by the lock cylinder 19 is achieved even upon a repeated pivoting of the lock cylinder 19 to perform opening and/or closing operations of the lock mechanism.

A movable part 21*a* of a double throw switch 21 is coupled with the output member or bar 22 so as to ensure that the double throw switch 21 retains an unequivocal switching position even in case of a repeated pivoting of the lock cylinder 19 during a locking operation. An input member 24 for a lock mechanism 28 is also positively coupled with the bar or output member 22 provided with the recess 22*a*. A manual locking button is likewise coupled with the input member 24.

The first double throw switch 21 arranged in the central locking station 5 is arranged, together with the second double throw switch 18 arranged in the pulse generator 7, in a current supply line for the electric motor 9 of the pump 8. The two double throw switches 18, 21 are, in the rest position of the locking mechanism, in opposite switching positions so that the current supply is interrupted and the electric motor is turned off.

The mode of operation of the pneumatic central locking mechanism illustrated in FIG. 1 is, briefly, as follows:

Assuming that the position illustrated in FIG. 1 corresponds to a locked condition and the doors 30, 31 as well as the trunk lid 32 and fuel tank cover 33 are to be opened then, after an introduction of a key into the lock cylinder 19, the lock cylinder 19 is pivoted counterclockwise against the bias of the springs 20 from the illustrated central position. The first double throw switch 21 is changed over and thus, together with the illustrated switching position of the second double throw switch 18, a completed circuit or closed connection is established in the current supply circuit for the electric motor 9. The thus-activated electric motor 9 then drives the pump 8, the vacuum line 13 of which is coupled by way of the reversing valve 11 to the feed line 14 and the operating elements 1, 3, and 16. By the movement of the key at the central locking station 5, the associated lock 28 has been urged into an open position.

Due to a buildup of a vacuum in line 2 and in the operating chambers of the operating members 1 for the doors 30, 31, the corresponding locking devices of the doors 30, 31 are likewise moved into an open position. By way of a throttle 26, which is moderate in its effect, a sufficiently high vacuum is subsequently also built up in the locking devices 35,36 for the fuel tank cover 33 and trunk lid 32, so that also these locking devices 35,36 are moved into an open position.

Only at a subsequent point in time can a sufficiently high vacuum then also be built up in the further operating member 16 by way of the throttle 17 which is stronger in its effect, which vacuum would be capable of overcoming the locking force of the detent spring 15. Since this locking force and/or vacuum required to overcome the force of the detent spring is higher than the corresponding operating force in any of the locking devices 34, 35, or 36, it is ensured that a response by the further operating member 16 occurs functionally at a later point in time than the opening of all the locking devices.

Consequently, by means of the throttle 17, a functional ranking order of the operating members 1, 3, 16 is established. Additionally, by means of the throttle 26, connected forwardly of the operating members 3 for the trunk lid 32 and fuel tank cover 33, a corresponding functional ranking order has been provided between the doors 30, 31 and the trunk lid 32 and fuel tank cover 33 so that a response of the operating members 1 for the doors 30,31 is accelerated or precedes the response of the operating members 3.

By virtue of the response of the further operating member 16 in the pulse generator 7, the second double throw switch 18 and reversing valve 11 are switched over simultaneously and together thereby causing an interruption of the current supply to the electric motor 9 so that the pump 8 is switched off.

By virtue of the response of the further operating member 16 and the corresponding displacement of the movable part 11*a*, the wedge-shaped indexing member 15*a* engages the groove 11*c* and, with the movable part 11*a* in such position, the vacuum line 13 is blocked and the excess pressure line 12 is opened or uncovered thereby conditioning the reversing valve 11 for supplying excess pressure to the line 14 so as to enable an opening of the locks associated with the operating members 1,3 as well as to enable a subsequent displacement of the movable part 11*a* to the position illustrated in FIG. 1 by virtue of the excess pressure being supplied to the single chamber of the further operating member 16.

As shown in FIG. 2, a central locking mechanism is provided which includes two central locking stations generally designated by the reference numeral 6. The two central locking stations essentially correspond to the central locking station 5 of FIG. 1. However, with a multiple arrangement of the central locking stations, pneumatic operating members 1 are arranged thereat for operating the locks associated with, for example, the two front doors 30 of the vehicle 29.

To prevent the manipulation of the key in the lock cylinders 19 from becoming too difficult due to the entrainment of the associated operating members 1, the operating members 1 are coupled by way of a member having a slotted hole 27 with the corresponding input members 24 for the respective locks provided at the vehicle doors 30. The slots 27 have a defined clearance which corresponds to a switching distance of the input member 24 for the respective lock mechanisms. Additionally, the two double throw switches 21 of the two central locking stations 6 are connected in parallel. As can readily be appreciated by virtue of the two central locking stations 6, it is possible to actuate the central locking mechanism from either location with the mode of operation then being entirely in correspondence with the mode of operation described hereinabove in connection with the central locking arrangement of FIG. 1.

While we have shown and described only two embodiments in accordance with the present invention, it is understood that the same is not limited thereto but is susceptible of numerous changes and modifications as known to one having ordinary skill in the art, and we therefore do not wish to be limited to the details shown and described herein, but intend to cover all such modifications as are encompassed by the scope of the appended claims.

We claim:

1. A pneumatic central locking mechanism for controlling lock means arranged at doors and/or hinged cover means of motor vehicles, the central locking mechanism including one pneumatic operating means provided at each of the doors and hinged cover means which are to be locked by a central locking operation for locking and unlocking the locking means associated with the doors and hinged cover means, pump means for producing an excess pressure and a vacuum, an electric drive motor for driving the pump means, a reversing valve means for selectively controlling a feeding of the excess pressure and vacuum to the pneumatic operating means, switch means for controlling an activation of the electric drive motor, and at least one central locking means operatively connected to the switch means for operating the same in response to a key actuation of the central locking means, characterized in that a further pneumatic operating means controls a positioning of the reversing valve means, means are provided for pneumatically connecting the further pneumatic operating means in parallel to the pneumatic operating means provided at the doors and hinged cover means, means are provided for applying a predetermined load resistance on the further pneumatic operating means which must be overcome upon each actuation of the further pneumatic operating means, means are provided for delaying an actuation of the further pneumatic operating means until the other pneumatic operating means have been actuated, and in that the further pneumatic operating means is operable to switch a positioning of the reversing valve means, so that following a completion of a locking operation, the reversing valve means is in a position required for an opposite locking operation.

2. A pneumatic central locking mechanism according to claim 1, characterized in that the switch means is constructed as a double throw switch means, a second double throw switch means is operatively connected with the further pneumatic operating means so as to be positioned thereby simultaneously with the first mentioned switch means, means are provided for electrically connecting the two double throw switch means to each other and to a current supply for the electric drive motor, and in that, in a rest position of the central locking mechanism means, the two double throw switch means are disposed in opposite switching positions so as to interrupt a current supply to the electric drive motor.

3. A pneumatic central locking mechanism according to claim 2, characterized in that the means for delaying actuation of the further pneumatic operating means includes a throttle means disposed in the means for pneumatically connecting the further pneumatic operating means with the pneumatic operating means provided at the doors and hinged cover means.

4. A pneumatic central locking mechanism according to claim 3, characterized in that each of the pneumatic operating means are constructed as single chamber members, and in that a single feed line leading to each of the pneumatic operating means is provided at the doors and hinged cover means is provided for pneumatically connecting the same with the reversing valve means.

5. A pneumatic central locking mechanism according to claim 3, characterized in that the reversing valve means includes a movable part, the means for applying a predetermined load resistance includes a detent means provided at the reversing valve means for tensioning the movable part of the reversing valve means into two respective end positions.

6. A pneumatic central locking mechanism according to claim 5, characterized in that said detent means is constructed so as to reverse an effective force direction upon passing through a central position.

7. A pneumatic central locking mechanism according to claim 6, characterized in that said detent means is constructed as one of a spring and a latch.

8. A pneumatic central locking mechanism according to claim 6, characterized in that said detent means acts upon the movable part of the reversing valve means so as to directly apply the load resistance to the further pneumatic operating means.

9. A pneumatic central locking mechanism according to claim 5, characterized in that the predetermined load resistance is higher than a load resistance of any of the locking means arranged at the doors and hinged cover means.

10. A pneumatic central locking mechanism according to claim 5, characterized in that the central locking means includes a lock cylinder means adapted to be pivoted by a key, means are provided for elastically tensioning the lock cylinder means into a central rest position, means are provided for coupling the lock cylinder means to a movable part of the first mentioned double throw switch means including a recess having a predetermined axial length corresponding to a switching displacement of such double throw switch means, and in that means are provided for tensioning the movable part of such double throw switch means into one of two end positions, said tension means are capable of reversing a direction of force when passing through a central position.

11. A pneumatic central locking mechanism according to claim 10, characterized in that the tensioning means is constructed as one of a catch and a detent spring.

12. A pneumatic central locking mechanism according to claim 10, characterized in that a plurality of central locking means are provided each of which includes a lock cylinder means, and in that an additional pneumatic operating means is provided at each of the plurality of central locking means for operating locking means associated with each central locking means.

13. A pneumatic central locking mechanism according to claim 12, characterized in that means are provided for coupling each of the additional pneumatic operating means to lock operating means interposed between the lock cylinder means and associated additional pneumatic operating means, said last-mentioned coupling means including a slotted hole having an axial length corresponding to a switching distance of an associated locking means.

14. A pneumatic central locking mechanism according to claim 13, characterized in that means are provided for controlling an order in which the pneumatic operating means arranged at the doors and hinged cover means will be actuated.

15. A pneumatic central locking mechanism according to claim 14, characterized in that a single feed line leading to each of the pneumatic operating means provided at the doors and hinged cover means is provided for pneumatically connecting such pneumatic operating means with the reversing valve means, and in that the order controlling means includes a throttle means arranged in the feed lines leading to the pneumatic operating means provided at the hinged cover means with the feed lines leading to the pneumatic operating means provided at the doors being unimpeded.

16. A pneumatic central locking mechanism according to claim 15, characterized in that a throttle effect of the throttle means arranged in the feed lines is less than a throttle effect of the throttle means associated with the further pneumatic operating means.

17. A pneumatic central locking mechanism according to one of claims 1 or 2, characterized in that a plurality of central locking means are provided, and in that an additional pneumatic operating means is provided at each of the central locking means for operating locking means associated with each of the central locking means.

18. A pneumatic central locking mechanism according to one of claims 1 or 2, characterized in that means are provided for controlling an order in which the pneumatic operating means arranged at the doors and hinged cover means will be actuated.

19. A pneumatic central locking mechanism according to claim 18, characterized in that the means for delaying actuation of the further pneumatic operating means includes a throttle means disposed in the means for pneumatically connecting the further pneumatic operating means with the pneumatic operating means provided at the doors and hinged cover means.

20. A pneumatic central locking mechanism according to claim 19, characterized in that a single feed line leading to each of the pneumatic operating means provided at the doors and hinged cover means is provided for pneumatically connecting such pneumatic ooerating means with the reversing valve means, and in that the order controlling means includes a throttle means arranged in the feed lines leading to the pneumatic operating means provided at the hinged cover means with the feed lines leading to the pneumatic operating means provided at the doors being unimpeded.

21. A pneumatic central locking mechanism according to claim 20, characterized in that a throttle effect of the throttle means arranged in the feed lines is less than a throttle effect of the throttle means associated with the further pneumatic operating means.

* * * * *